United States Patent [19]

O'Loughlin

[11] 4,365,109

[45] Dec. 21, 1982

[54] COAXIAL CABLE DESIGN

[75] Inventor: James P. O'Loughlin, Albuquerque, N. Mex.

[73] Assignee: The United States of America as represented by the Secretary of the Air Force, Washington, D.C.

[21] Appl. No.: 318,653

[22] Filed: Nov. 5, 1981

Related U.S. Application Data

[63] Continuation-in-part of Ser. No. 115,513, Jan. 25, 1980, abandoned.

[51] Int. Cl.[3] ..... H01B 7/26

[52] U.S. Cl. ..... 174/109; 174/28; 174/36; 174/108

[58] Field of Search ..... 174/28, 36, 108, 109

[56] References Cited

U.S. PATENT DOCUMENTS

| | | | |
|---|---|---|---|
| 1,948,616 | 2/1934 | Fischer | 174/109 X |
| 2,792,442 | 5/1957 | Parce | 174/28 X |
| 3,291,891 | 12/1966 | Sharp | 174/36 |
| 3,588,317 | 6/1971 | Hutchins | 174/108 |
| 3,601,721 | 8/1971 | Justice | 174/109 X |
| 3,636,234 | 1/1972 | Wakefield | 174/109 X |
| 4,095,040 | 6/1978 | Cookson | 174/28 |

FOREIGN PATENT DOCUMENTS

| | | | |
|---|---|---|---|
| 1053054 | 3/1959 | Fed. Rep. of Germany | 174/36 |

*Primary Examiner*—R. R. Kucia

*Attorney, Agent, or Firm*—Donald J. Singer; Jacob N. Erlich

[57] ABSTRACT

It has been discovered that the transient voltage which develops on the outer sheath of a coaxial cable under pulse voltage excitation is a result of the inequality between the self inductance of the sheath and the mutual inductance between the sheath and the center conductor. The self inductance of the sheath is always less than the mutual inductance by a small amount because of the finite thickness of the sheath. By manipulating the design of the outer sheath, an equality between the sheath self inductance and the sheath to inner conductor mutual inductance can be achieved which results in a cancellation of the transient voltage on the sheath when the cable is pulsed.

4 Claims, 2 Drawing Figures

COAXIAL CABLE DESIGN

STATEMENT OF GOVERNMENT INTEREST

The invention described herein may be manufactured and used by or for the Government for governmental purposes without the payment of any royalty thereon.

CROSS REFERENCE TO RELATED APPLICATION

This is a continuation-in-part of copending patent application Ser. No. 115,513 filed Jan. 25, 1980, now abandoned.

BACKGROUND OF THE INVENTION

This invention relates to an improved coaxial cable design and, more particularly, the invention is concerned with providing a coaxial pulse transmission cable wherein the sheath self inductance and the sheath to inner conductor mutual inductance are maintained near equality in order to cancel transient voltage on the sheath when the cable is pulsed.

When a coaxial cable is used for high voltage pulse transmission, a transient voltage appears on the outer sheath conductor. Although the magnitude of the transient is in the order of only a few percent, this amounts to several kilovolts in many cases and must be carefully considered in terms of its effect on instrumentation, control and safety.

To a first approximation, theoretically a coaxial cable should not develop any voltage on the outer sheath. A more refined analysis shows that the complete cancellation depends upon the self inductance of the sheath being exactly equal to the mutual inductance between the sheath and the center conductor. This condition is never satisfied due to current distribution effects, even when the distribution is uniform and radially symmetric. The situation becomes worse when proximity effects are accounted for.

SUMMARY OF THE INVENTION

The invention is concerned with coaxial cables wherein the sheath self inductance is balanced to the mutual inductance in order to achieve a large reduction in the transient voltage developed on the sheath under pulse conditions.

A means forming part of this invention for increasing the self inductance with respect to the mutual inductance and thus achieve the desired balance is the utilization of a spiral slit in the outer sheath. This slit has a pitch (turns per unit length) dependent upon the sheath's radius and thickness. By appropriate selection of the pitch, an increase in the self inductance is maintained so as to make the self inductance of the outer sheath equal to the mutual inductance between the outer sheath and the center conductor thereby achieving a large reduction in the transient voltage developed on the outer sheath when the cable is pulsed.

Accordingly, it is an object of the invention to provide a coaxial cable design in which the outer sheath is manipulated to achieve an equality between the sheath self inductance and the sheath to inner conductor mutual inductance which results in a cancellation of the transient voltage on the sheath when the cable is pulsed.

Another object of the invention is to provide a coaxial cable design utilizing a spiral slit with edges overlapped and insulated to avoid transient voltages under pulsed conditions.

Still another object of the invention is to provide a coaxial cable design wherein a spiral slit in the outer sheath controls the self inductance by varying the pitch.

A further object of the invention is to provide a coaxial cable design which when used to transmit high voltage pulses will reduce by at least an order of magnitude, the voltage developed on the sheath of the cable.

These and other objects, features and advantages will become more apparent after considering the following detailed description taken in conjunction with the annexed drawings and appended claims.

DESCRIPTION OF A PREFERRED EMBODIMENT

The inventor has theoretically explained and experimentally verified that the transient voltage which develops on the outer sheath of a coaxial cable under pulse voltage excitation is a result of the fact that the self inductance of the sheath is not equal to the mutual inductance between the sheath and center conductor. Also the self inductance of the sheath is always less than the mutual by a small amount due to the fact that the sheath has a finite thickness.

In this invention the design of a coaxial cable is arranged to much more closely balance the sheath self inductance to mutual inductance and thereby achieve a large reduction in the transient voltage developed on the sheath under pulse conditions.

Figure 1:
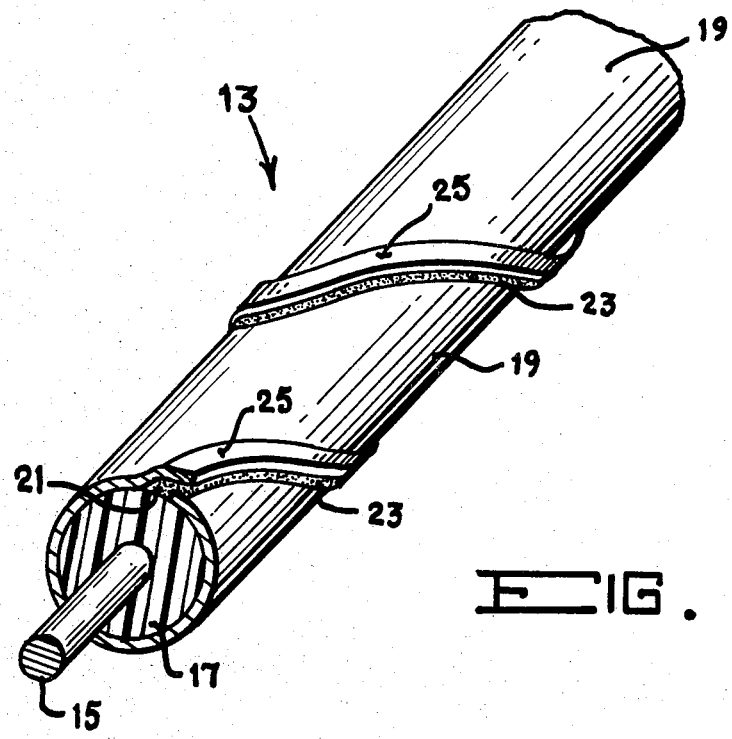
FIG. 1 is a view in perspective of a section of an improved coaxial cable according to the invention showing the overlapping slit arrangement with the insulation therebetween.
Figure 2:
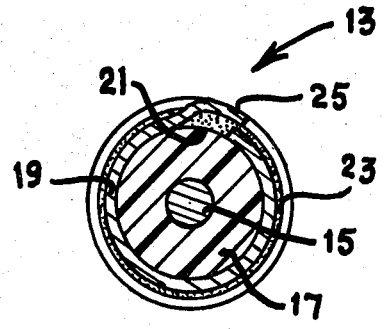
FIG. 2 is a view in cross-section of the improved coaxial cable design.

Accomplishment of this balance is achieved by the embodiment of FIGS. 1 and 2. In these Figures is shown a coaxial cable 13 having a center conductor 15 surrounded by dielectric material 17 which in turn is surrounded by a metallic sheath 19. The sheath 19 has a slit 21 with a pitch of n turns per centimeter of length. The sheath 19 has a portion thereof overlap at the slit 21 and material 23 provides insulation between the overlapping portions of the sheath 19. The insulation material 23 may be made integral with the dielectric 17 and of the same material. The slit 21 in the sheath has a conductive portion 25 overlap the slit 21, but the overlap is insulated which effectively causes the inductance of the sheath 19 to be higher than without the slit 21. The increase in inductance per cm due to the slit is given very closely by the equation (1) from "Inductance Calculations Working Formulas and Tables," Frederick Grover, Dover 1962.

$$L_2 = 0.004\pi^2\alpha^2 n^2 \quad \text{(Microhenries/centimeter)} \qquad (1)$$

Where:

$\alpha$ = Radius of the sheath 19 (cm.)

n = Turns per centimeter of the slit 21 or pitch $L_2$ = Inductance due to the slit in the sheath 19

The pitch of the slit 21 is selected to cause an increase in the self inductance which is just enough to make the self inductance of the sheath 19 equal to the mutual inductance between the sheath 19 and center conductor 15. The difference between the mutual inductance between outer sheath 19 and conductor 15 and the self inductance of sheath 19 is given by equation (2):

$$\Delta M_{12} = .001\left[1 - \frac{(R_2 - T)^2}{(2R_2 - T)T^2}\left[\frac{R_2^3}{3(R_2 - T)^2} - \frac{R_2}{3} + \frac{4T}{3} - 2(R_2 - 1)\ln\left(\frac{R_2}{R_2 - T}\right)\right]\right] \text{ Microhenries/cm} \quad (2)$$

Where:

1 n=natural logarithm $R_2$=Radius of sheath 19 (cm.)

T=Thickness of sheath 19 (cm.)

$L_2$=Inductance due to slit 21 in sheath 19 (cm.)

$\Delta M_{12}$=Difference between the mutual and self inductance without the slit As an example, consider a cable with a center conductor of 1.35 cm. dia., a sheath of 4.06 cm. dia. and a sheath thickness of 0.025 cm. Equating the inductances we have:

$$L_2 = \Delta M_{12} = 8.22281 \times 10^{-6} \quad \text{(Microhenries/cm)}$$

The difference of $8.22281 \times 10^{-6}$ is used to solve equation (1) for n which is n=0.007109 turns per cm. or equivalently 140.66 cm. per turn of the slit.

Thus there has been shown a coaxial cable design wherein the outer sheath 19 is manipulated with spiral slit 21 to achieve an equality between the sheath self inductance $L_2$ and the sheath to inner conductor mutual inductance $M_{12}$ to cancel transient voltages on outer sheath 19 when the cable 13 is pulsed.

Although there have been described the fundamental and unique features of my invention as applied to a preferred embodiment, various other embodiments, variations, adaptations, substitutions, additions, omissions, and the like may occur to, and can be made by, those of ordinary skill in the art, without departing from the spirit of the invention.

I claim:

1. In a coaxial cable having a center conductor, an outer conductive sheath surrounding said center conductor, a dielectric material between said center conductor and said outer sheath, and said outer sheath and said center conductor each having an inductance, the improvement therein comprising means incorporated within said coaxial cable for controlling said inductance of said outer sheath such that said inductance of said outer sheath is substantially equal to the mutual inductance between said outer sheath and said center conductor thereby substantially eliminating transient voltage on said outer sheath when said coaxial cable is pulsed.

2. In a coaxial cable as defined in claim 1 wherein said inductance controlling means comprises a spiral slit formed in said outer conductive sheath, said spiral slit having a predetermined pitch, said predetermined pitch being sufficient to increase said inductance of said outer sheath so as to be substantially equal to said mutual inductance between said outer sheath and said center conductor, said spiral slit having overlapping edges and an insulating material being interposed between said overlapping edges.

3. A method of substantially eliminating transient voltage on an outer conductive sheath of a coaxial cable having a center conductor when said cable is pulsed, said method comprising the steps of:

incorporating means for controlling inductance of said outer sheath within said coaxial cable; and controlling said inductance of said outer sheath such that said inductance of said outer sheath is made substantially equal to the mutual inductance between said outer sheath and said center conductor.

4. A method of substantially eliminating transient voltage on an outer sheath of a coaxial cable as defined in claim 3 wherein said step of incorporating said inductance controlling means within said coaxial cable comprises the steps of:

forming a spiral slit having overlapping edges in said outer conductive sheath;

making said spiral slit of a predetermined pitch;

said predetermined pitch being sufficient to increase said inductance of said outer sheath so as to be substantially equal to said mutual inductance between said outer sheath and said center conductor; and interposing an insulating material between said overlapping edges of said spiral slit.

* * * * *